US007610001B2

(12) United States Patent
Tsunemi et al.

(10) Patent No.: US 7,610,001 B2
(45) Date of Patent: Oct. 27, 2009

(54) DEVELOPING APPARATUS USING NON-MAGNETIC MONO-COMPONENT TONER AND METHOD OF ADDING TONER TO SAME

(75) Inventors: Koichi Tsunemi, Suwon-si (KR); Sang-woo Kim, Seoul (KR); Jun-ho Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 530 days.

(21) Appl. No.: 11/493,632

(22) Filed: Jul. 27, 2006

(65) Prior Publication Data

US 2007/0110479 A1 May 17, 2007

(30) Foreign Application Priority Data

Nov. 17, 2005 (KR) ..... 10-2005-0110129

(51) Int. Cl.
*G03G 15/08* (2006.01)

(52) U.S. Cl. ..... 399/254; 399/255; 399/258; 399/259

(58) Field of Classification Search ..... 399/254, 399/255, 258, 259
See application file for complete search history.

(56) References Cited

FOREIGN PATENT DOCUMENTS

| | | |
|---|---|---|
| CN | 1452021 A | 10/2003 |
| JP | 09-127719 | 5/1997 |
| JP | 2002-006557 | 1/2002 |
| JP | 2002-268263 | 9/2002 |

OTHER PUBLICATIONS

Electronic Translation of JP 2002268263, Yagi et al.*

* cited by examiner

*Primary Examiner*—David M Gray
*Assistant Examiner*—Ryan D Walsh
(74) *Attorney, Agent, or Firm*—Roylance, Abrams, Berdo & Goodman, L.L.P.

(57) ABSTRACT

A developing apparatus includes an image receptor and a developing unit having a developing roller facing the image receptor. New toner can be added to the developing unit when existing toner in the developing unit is consumed. The added toner and existing toners are formed of cores and external additives. At least one of the cores or the external additives of the added toner is different from that of the existing toner. When the charge amount of the two toners are Q1 and Q2, respectively, the ratio Q1/Q2 is greater than 0.6 and smaller than 1.7, and the absolute values of Q1 and Q2 are 10 μC/g or greater, respectively.

22 Claims, 4 Drawing Sheets

DEVELOPING APPARATUS USING NON-MAGNETIC MONO-COMPONENT TONER AND METHOD OF ADDING TONER TO SAME

CROSS-REFERENCE TO RELATED PATENT APPLICATION

This application claims the benefit under 35 U.S.C. § 119 (a) of Korean Patent Application No. 10-2005-0110129, filed on Nov. 17, 2005, in the Korean Intellectual Property Office, the entire disclosure of which is hereby incorporated by reference.

BACKGROUND OF THE INVENTION

1. Field of the Invention

The present invention relates to a developing apparatus that uses a non-magnetic mono-component toner. More particularly, the present invention relates to an apparatus in which toner can be added to the developing unit when existing toner in the developing unit is consumed, and a method for adding toner to the developing unit.

2. Description of the Related Art

The life span of a developing unit in a conventional developing apparatus that uses a non-magnetic mono-component developer typically depends on the amount of toner contained in the developing unit and the printing speed. Generally, a developing apparatus contains enough toner to print from 2000 to 3000 sheets. The life span of the components of the developing unit (for example, the developing roller, the developing blade, the supply roller, etc.), however, is longer than this. Therefore, when the toner is depleted, the components must be changed, even though they have a remaining useful lifespan. This provides certain advantages. For example, a manufacturing firm does not have to provide after sales services and a user can print high quality images by replacing the developing unit. However, since environmental waste should be reduced as much as possible, research has been conducted on methods of changing the toner in the developing unit and reusing the developing unit. These methods have typically been used with developing apparatuses that use a dual-component developing agent.

When only toner is replaced in the developing unit, toner having the same cores and external additives as the existing toner is used. A core is a particle including at least resin and colorant and has an average diameter of 3 to 10 μm. The external additives are wax or a charge control agent (CCA), which are not added to the cores. Toner can be produced using a pulverization method in which the raw material is fused and mixed and then pulverized and classified, or using a polymerization method in which a monomer is suspended and emulsified to be polymerized.

Generally, when toners with different compositions are mixed in a developing unit, one toner is charged positively and another toner is charged negatively. Thus, background contamination occurs in a printed image, and the optical density of a solid part of the printed image increases unnecessarily, thereby increasing toner consumption. In some cases, the optical density of the solid part decreases, and consequently, high quality images cannot be regularly produced.

Accordingly, there is a need for a developing apparatus that uses non-magnetic mono-component toner and produces high quality images which can be refilled.

SUMMARY OF THE INVENTION

An aspect of the present invention is to address at least the above problems and/or disadvantages and to provide at least the advantages described below. Accordingly, an aspect of the present invention is to provide a developing apparatus that uses non-magnetic mono-component toner, by which high quality images can be printed for a long period of time even when two types of toners with different compositions are used in a developing unit.

According to an aspect of the present invention, a developing apparatus comprising an image receptor and a developing unit having a developing roller facing the image receptor is provided. Toner can be added to the developing unit when existing toner in the developing unit is consumed. At least one of the cores or the external additives of the added toner is different from that of the existing toner, and where the charge amounts of the toners are Q1 and Q2, respectively, the ratio Q1/Q2 is greater than 0.6 and smaller than 1.7, and the absolute values of Q1 and Q2 are 10 μC/g or greater, respectively.

When the charge amount of the mixture of added and existing toner of two different types is Q12, the ratios Q1/Q12 and Q2/Q12 may be in the range of 0.6 to 1.7.

The difference between the charge amounts per mass (Q/M) of two toners and the difference between the toner masses per area (M/A) of the two toners on the developing roller may be respectively 40% or less.

The developing unit may comprise two or more agitators that agitate and transfer toners inside the developing unit to the developing roller. The developing unit may comprise four agitators or less.

The volume mean diameter of the two toners may be in the range of 4 to 12 μm, and the difference in the percentages of the particles having a diameter of 5 μm or less in the two toners may be less than 15%, numerically.

The volume mean diameter of the two toners may be in the range of 4 to 12 μm, and the difference of the volume mean diameters of the two toners may be within 1.5 μm. The difference in the percentages of the particles having a diameter of 5 μm or less in the two toners may be less than 15%, numerically.

The two toners may have polyester-type cores, and the moving speed of toner being moved by the agitators may be lower than a developing process speed.

According to another aspect of the present invention, a developing apparatus comprising an image receptor and a developing unit having a developing roller facing the image receptor is provided. Toner can be added when existing toner in the developing unit is consumed. The developing unit comprises two or more agitators that agitate and transfer toner inside the developing unit to the developing roller. At least one of the cores or the external additives of the added toner is different from that of the existing toner, and the volume mean diameter of two toners is in the range of 4 to 12 μm.

According to another aspect of the present invention, a developing apparatus comprising an image receptor and a developing unit having a developing roller facing the image receptor is provided. Toner can be added when existing toner in the developing unit is consumed. The developing unit comprises two or more agitators that agitate and transfer toner inside the developing unit to the developing roller. The cores of the added toner are different from the cores of the previously used toner, and the volume mean diameters of the two toners are in the range of 4 to 12 μm, and the difference in the volume mean diameters of the two toners is within 1.5 μm , and the difference in the percentages of the particles of 5 μm or less in the two toners is 15% or less, numerically.

According to another aspect of the present invention, a method of adding toner to a developing unit having an existing toner formed of cores and external additives disposed therein is provided. The method comprises the step of adding an added toner to the developing unit so that it mixes with the existing toner. The added toner is formed of cores and external additives, and at least one of the cores or the external additives of the added toner is different than that of the existing toner. Further, the ratio Q1/Q2 is in the range of 0.6 to 1.7, and the absolute values of Q1 and Q2 are 10 μC/g or greater, where the charge amounts of the toners are Q1 and Q2, respectively.

According to another aspect of the present invention, a method of adding toner to a developing unit having an existing toner formed of cores and external additives disposed therein is provided. The method comprises the step of adding an added toner to the developing unit so that it mixes with the existing toner. The added toner is formed of cores and external additives, and at least one of the cores or the external additives of the added toner is different than that of the existing toner. The volume mean diameters of the existing and added toners are in the range of 4 to 12 μm.

According to another aspect of the present invention, a method of adding toner to a developing unit having an existing toner formed of cores and external additives disposed therein is provided. The method comprises the step of adding an added toner to the developing unit so that it mixes with the existing toner. The added toner is formed of cores and external additives, and the cores of the added toner are different than those of the existing toner. The volume mean diameters of the existing and added toners are in the range of 4 to 12 μm, the difference in the volume mean diameters of the existing and added toners are within 1.5 μm, and the difference in the percentages of the particles having a diameter of 5 μm or less is 15% or less numerically.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention and are merely exemplary. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

The present invention will now be described more fully with reference to the accompanying drawings, in which exemplary embodiments of the invention are shown.

Figure 1:
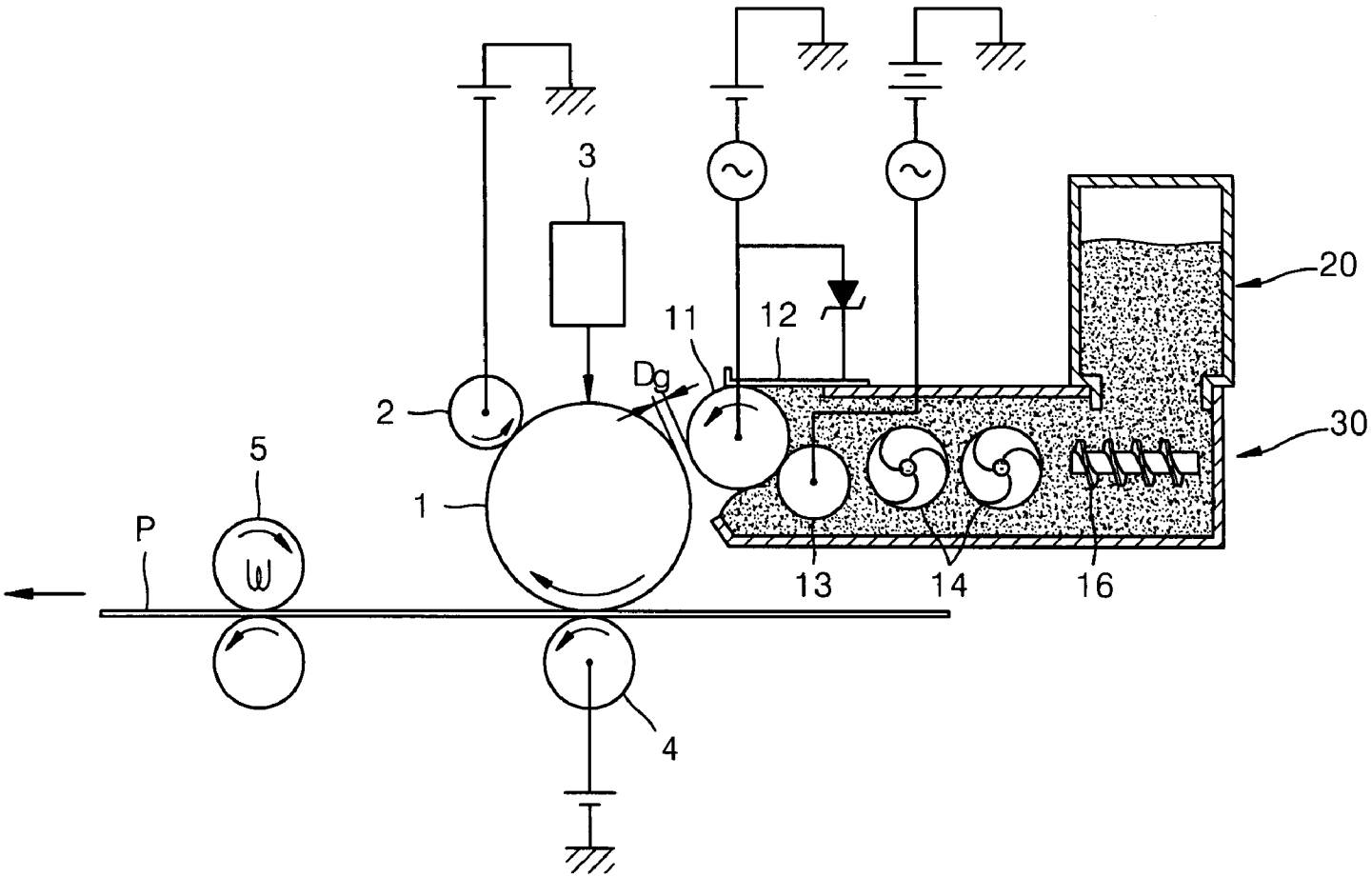
FIG. 1 is a schematic view of a developing apparatus according to an exemplary embodiment of the present invention.
Figure 2:
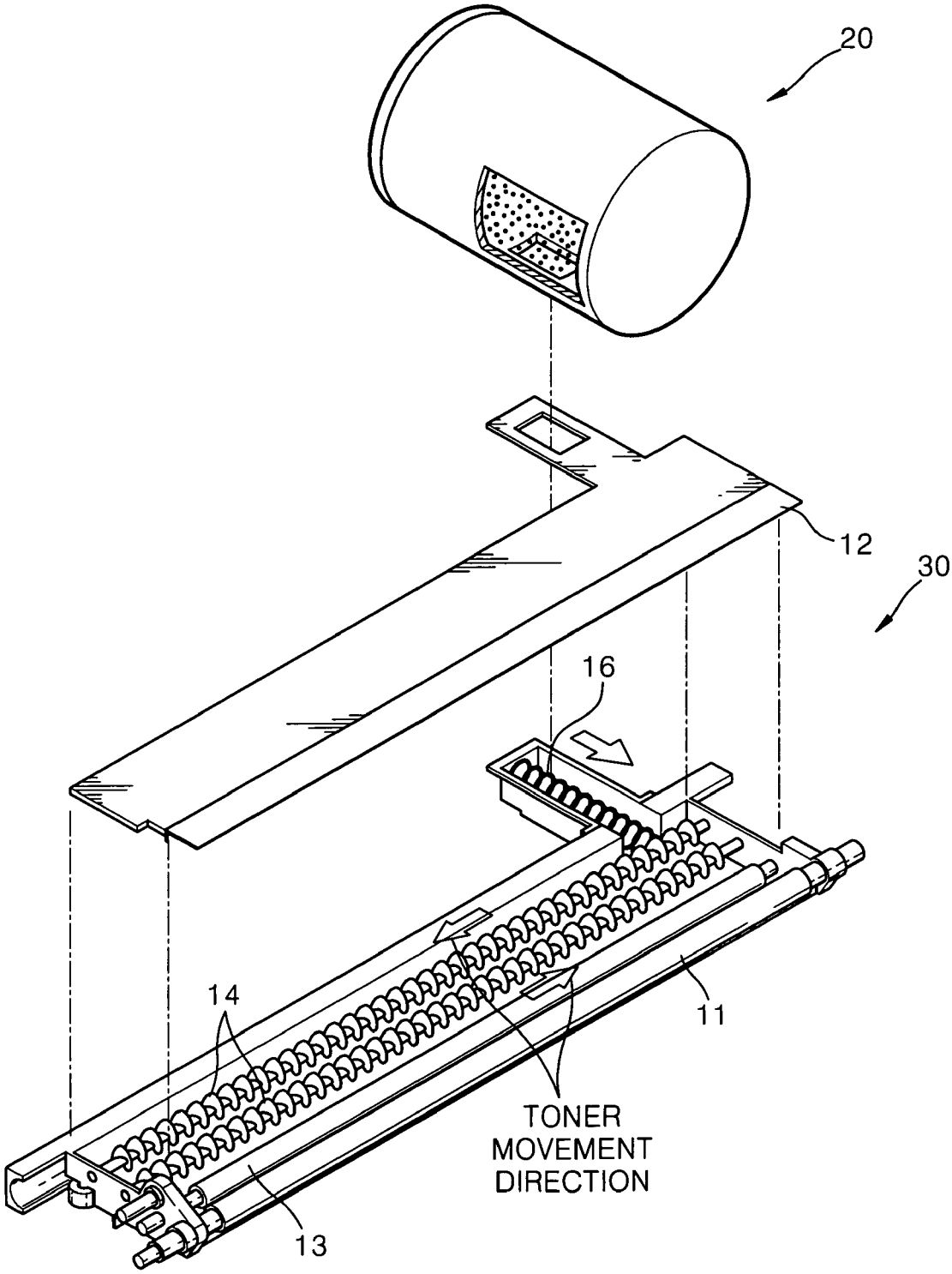
FIG. 2 is an exploded perspective view of a developing unit of FIG. 1.

FIG. 1 is a schematic view of an electro-photographic developing apparatus according to an exemplary embodiment of the present invention, and FIG. 2 is an exploded perspective view of a developing unit of FIG. 1. Referring to FIGS. 1 and 2, the developing apparatus includes an image receptor 1, a charging unit 2, an exposing unit 3, a developing unit 30, a transfer unit 4, and a fusing unit 5. The image receptor 1 may be a photosensitive drum or a photosensitive belt or an electrostatic drum or an electrostatic belt. A photosensitive drum is used in the present exemplary embodiment. The charging unit 2 charges a surface of the image receptor 1 with a uniform potential. The charging unit 2 may be a charging roller to which a charging bias voltage is applied, or a corona discharging unit. The exposing unit 3 scans light corresponding to image information onto the surface of the image receptor 1 to form an electrostatic latent image. The exposing unit 3 may be a laser scanning unit (LSU) using a laser diode as a light source. When an electrostatic drum or belt is used as the image receptor 1, the exposing unit 3 is replaced with an electrostatic recording head. The developing unit 30 supplies toner to the electrostatic latent image and develops the electrostatic latent image into a visible toner image. The toner image is transferred to a recording medium P by a transfer bias voltage applied to the transfer unit 4 and is then fused by the fusing unit 5.

The developing unit 30 includes a developing roller 11, a regulation blade 12, a supplying roller 13, and two agitators 14. The surface of the developing roller 11 of a non-contact type developing apparatus of the present exemplary embodiment is separated from the surface of the image receptor 1 by a developing gap Dg. The developing gap Dg may range from several tens to hundreds of μm. A developing bias voltage is applied to the developing roller 11 to develop toner into an electrostatic latent image. The agitators 14 transfer the toner to the developing roller 11 and the supplying roller 13. The agitators 14 may be augers as illustrated in FIG. 2. The supplying roller 13 removes toner remaining on the developing roller 11 after the toner has passed through the developing gap Dg and simultaneously supplies new toner to the surface of the developing roller 11. A bias voltage is applied to the supplying roller 13 to attach toner to the developing roller 11. The regulation blade 12 is elastically pressed to the surface of the developing roller 11 to charge toner attached to the surface of the developing roller 11. At the same time, it regulates the thickness of toner. A bias voltage may be applied to the regulation blade 12 to charge toner.

A toner hopper 20 is changed to add new toner to the developing unit 30. A transfer unit 16 transfers the toner coming from the toner hopper 20 to the developing unit 30 toward the agitators 14.

Toner is a mixture of cores, which are formed of a base resin and internal additives, and external additives. The composition of toner may vary according to the type of developing apparatus. Since toner which is to be added to the developing unit 30 must have the same composition as the previously used toner, that is, toner with a different composition cannot be used, a manufacturer should produce toner for each type of developing apparatus. Accordingly, the developing apparatus using non-magnetic mono-component toner of the exemplary embodiments of the present invention needs to be able to maintain high quality images even when toner having a different composition (for example, a toner in which at least one of the cores or the external additives is different) from the original toner is used.

Toner is agitated by the agitators 14 in the developing unit 30. When toners with different compositions are mixed rapidly, high quality images cannot be printed. Thus, more than two agitators 14 may be installed in the developing unit 30 for mild and effective agitation of a toner mixture. When many agitators are used, however, the driving torque of a motor used to rotate the agitators increases, the device used to drive the agitators becomes complicated, and the agitation and mixing times increase. Therefore, the number of the agitators 14 may be from 2 to 4. The rotation speed of the agitators 14 may be equal or different, and the maximum radius of the agitators 14 may be equal or different. Among the agitators, however, at least two agitators 14 close to the developing roller 11 preferably have the same diameter. The rotation direction of the agitators 14 may be any direction as long as the toner can be supplied to the supplying roller 13 and the developing roller 11. Also, the rotation direction of the agitator 14 may be the same as or different from the rotation direction of the supplying roller 13 or the developing roller 11. The supplying roller 13 and the developing roller 11 in a general mono-component development method rotate in the same direction. In other words, in an area where the supplying roller 13 and the developing roller 11 face each other, the surfaces thereof move in opposite directions. To mix toners with different compositions in a mild manner and to move them to the area where the developing roller 11 and the supplying roller 13 face each other, the moving speed of the toner by the agitators 14 may be lower than the developing process speed. The rotation speed of the agitators 14 is set to satisfy these conditions.

When toner with a different composition from the original toner is added to the developing unit 30 and the added toner and the original toner are agitated together by the agitator 14, the added toner should be charged to the same polarity as the original toner. If the polarities are the same, a high quality image can be produced even when two toners of different compositions are mixed. It was found during the development of the present invention that when the charge amounts of toners of different kinds are Q1 and Q2, respectively, if the ratio of charge amount Q1/Q2 is in the range of 0.6 to 1.7 and the absolute values of Q1 and Q2 are above 10 μC/g, the charging polarities of the toners are the same and high quality images can be printed. Here, the toner is charged to be positive or negative depending on the type of a developing apparatus, and the charge amount is expressed in absolute values. The toner charge amount may be measured using the method established by the Japanese Image Society in December, 1998, as described in the Journal of The Imaging Society of Japan, vol. 37, p. 461, and may be performed using a TB 203 type blow-off charge measurement apparatus manufactured by Toshiba Chemicals.

When the charge amount of mixed toner of two different types of toner mixed at the weight ratio of 1:1 is Q12, which is measured with the blow-off charging measuring apparatus, if the ratios of Q12 to the above described Q1 and Q2, that is, the ratios Q1/Q12 and Q2/Q12, are in the range of 0.6 to 1.7, high quality images still can be printed after the two different toners are mixed.

In order to properly and uniformly mix the toners with different compositions, a median value (D50) of the volume mean diameter of each toner should be in the range of 4 to 12 μm. When the diameter of toner particles is 4 μm or less, the fluidity of toner is reduced and cannot be mixed properly. When the diameter of toner particles is 12 μm or greater, the probability of the toners contacting each other will decrease and thus the toner cannot be charged uniformly. This is because when the diameter of toner is large, the gap between the toner particles is also large. To measure the volume mean diameter of toner particles, a Coulter Multisizer Type 2 or 3, available from Beckman Coulter, Fullerton, Calif., or any other measuring devices that can measure volume mean diameter, volume diameter distribution, number mean diameter, number diameter distribution, volume percentage, and number percentage, may be used. When the toners having different compositions are mixed mildly by the agitators 14, high quality images can be produced by controlling only the diameter of the toner particles.

The difference between the volume mean diameters of the toner particles may be 1.5 μm or less to mix the toners uniformly and promptly. If the difference is greater than 1.5 μm, the toners may not be mixed uniformly and the apparent density of toners may not be uniform either, thereby causing image quality to deteriorate.

The content of fine toner having a diameter of 5 μm or less affects the fluidity, charging characteristic, and durability of the toner. Though the volume and weight of the fine toner is small, the number of particles is large. Thus it is preferable to regulate the effects of the fine toner on the image quality based on the number of particles of the toner. The content of the fine toner can be measured using a particle size analyzer capable of measuring a number distribution, such as the Coulter Multisizer. The percentage of fine toner having a diameter of 5 μm or less in the toner having a volume mean diameter of 8-12 μm may depend on the manufacturing method and the classification method of toner, but is generally 5-30%. When the volume mean diameter of the toner decreases, the percentage of fine toner having a diameter of 5 μm or less increases, and thus the percentage of the fine toner in toner having a volume mean diameter of 4 μm may be greater than 60%. When the percentage of fine toner having a diameter of 5 μm or less changes, the probability of charging defect and fluidity defect may increase. The difference between the percentages of fine toner having a diameter of 5 μm or less in the previously used toner and the replenished toner is preferably set to 15% or less. For example, when the percentage of the fine toner having a diameter of 5 μm or less in the previously used toner is 10%, the percentage of the fine toner in the toner which is to be added later should not be greater than 25%. Also, when the percentage of the fine toner in the previously used toner is 20%, the percentage of the fine toner in the toner which will be added is allowed to be from 5 to 35%. This is because when the difference between the percentages of the fine toner in the previously used toner and the replenished toner is greater than 15%, the irregularity of the apparent density of a mixture of the two toners increases, thereby causing image quality to deteriorate.

The base resin of the toner used in the present invention may be a polyester resin, which has a rapid friction charging speed. The monomer substance forming the polyester of the two different kinds of toner does not need to be the same. If a styrene-acrylate type resin is used, the charging speed is low and the composition of external additives should be optimized, thereby causing a toner composition problem.

Using toner attached to the developing roller 11, the charge amount per mass (Q/M) and the toner mass per area (M/A)

can be measured. When the difference between the charge amounts per toner mass (Q/M) of two toners and the difference between the toner masses per area (M/A) of two toners are respectively 40% or less, high quality images can be realized when mixing two toners.

Hereinafter, experimental exemplary embodiments and comparison exemplary embodiments in which two kinds of toner are mixed by controlling the compositions of the cores and the external additives to test the image quality will be described. In the experiments, the image was printed using rebuilt experimental equipment, specifically, a Samsung CLP-510 model color laser printer manufactured by Samsung Electronics Co., Ltd., the assignee of the present invention. The CLP-510 laser printer has printing speeds of 6 pages/minute for color images and 24 pages/minute for monochrome images, and a developing process speed of 150 mm/s. The printer uses a developing method using a noncontact-type mono-component non-magnetic toner.

First Exemplary Embodiment

Two toners with the same cores and different external additives were used to check image quality. Toner AA was a mixture of core A and external additive A, and toner AB was a mixture of core A and external additive B. The mean diameter of toner AA and toner AB was in the range of 4 to 12 μm.

Core A:

Polyester Resin (acid value 5, Mw/Mn=30, Mw (weight average molecule amount)=90000, Mn (number average molecule amount)=3000) 92%/boron complex based charge control agent (CCA) 1%/carbon black 4%/ester type wax with $T_m$ (melting temperature)=70±3° C. 3%/volume mean diameter 8.5 μm, particles having a diameter of 20 μm or greater 0.1% (weight), particles having a diameter of 5 μm or less 17% (number)

External Additive A:

Hydrophobic silica having a specific surface (according to the BET method) of 200 $m^2/g$ and the surface treated with HMDS (hexamethyldisilazane) 1%/hydrophobic silica having a specific surface (according to the BET method) of 50 $m^2/g$ with the surface treated with HMDS 1%/$TiO_2$ 0.2%

External Additive B:

Hydrophobic silica having a specific surface (according to the BET method) of 300 $m^2/g$ and the surface treated with silicon oil 1%/hydrophobic silica having a specific surface (according to the BET method) of 120 $m^2/g$ with the surface treated with silicon oil 1%/$TiO_2$ 0.2%

As illustrated in FIG. 1, the developing unit 30 included two agitators 14. First, toner AA was added to the developing unit 30. A high quality image was printed.

When 20% of toner AA in the developing unit 30 was consumed, toner AB formed of core A and external additive B was added. A high quality image was printed.

Toner AA was added to an empty developing unit 30, and when 50% of toner AA was consumed, toner AB was added. A high quality image was printed.

Toner AA was added to an empty developing unit 30, and when 90% of toner AA was consumed, toner AB was added. A high quality image was printed. When 90% of the mixed toner of toner AA and toner AB in the developing unit 30 was consumed, toner AA was added. A high quality image was printed.

Second Exemplary Embodiment

Two toners with different cores and different external additives were used to check image quality. Toner AA was a mixture of core A (the same as in exemplary embodiment 1) and, external additive A (the same as in exemplary embodiment 1). Toner BC was a mixture of core B and external additive C. The mean diameter of toner AA and toner BC was in the range of 4-12 μm. The difference of the mean diameter of toner AA and toner BC was 1.2 μm, which is smaller than 1.5 μm. The difference in the percentages of the fine particles having a diameter of 5 μm or less of toner AA and toner BC is 11%, which is smaller than 15%.

Core B:

Polyester Resin (acid value 10, Mw/Mn=10, Mw=30000, Mn=3000) 92%/boron complex based charge control agent (CCA) 1%/carbon black 4%/ester type wax with $T_m$=70±3° C. 3%/volume mean diameter (D50, weight average) 7.3 μm, particles having a diameter of 20 μm or greater 0.1% (weight), particles having a diameter of 5 μm or less 28% (number)

External Additive C:

Hydrophobic silica having a specific surface (according to the BET method) of 130 $m^2/g$ with the surface treated with silicon oil 1.5%/hydrophobic silica having a specific surface (according to the BET method) of 50 $m^2/g$ with the surface treated with silicon oil 2%/$TiO_2$ 0.2%/resin bead with a mean diameter of 0.1 μm 0.2%

As illustrated in FIG. 1, the developing unit 30 included two agitators 14. Toner AA was added to the developing unit 30. A high quality image was printed.

When 20% of toner AA was consumed, toner BC was added and an image was printed. A high quality image was printed.

Toner AA was added to an empty developing unit 30. When 50% of toner AA was consumed, toner BC was added. A high quality image was printed.

Toner AA was added to an empty developing unit 30 and when 90% of toner AA was consumed, toner BC was added. A high quality image was printed. Then, when 90% of the toner, which was the mixture of toner AA and toner BC, was consumed, toner AA was added. A high quality image was printed.

Third Exemplary Embodiment

Two toners with different cores and the same external additives were used to check image quality. Toner CA was a mixture of core C and external additive A (the same as in exemplary embodiment 1). Toner DA was a mixture of core D and external additive A (the same as in exemplary embodiment 1). The mean diameter of toner CA and toner DA was in the range of 4-12 μm. The difference of the mean diameter of toner CA and toner DA was 1.1 μm, which is smaller than 1.5 μm. The difference in the percentages of the fine particles of 5 μm or less of toner CA and toner DA was 13%, which is smaller than 15%.

Core C:

Polyester Resin (acid value 5, Mw/Mn=30, Mw=90000, Mn=300) 92%/boron complex based charge control agent (CCA) 1%/carbon black 4%/ester type wax with $T_m$=70±3° C. 3%/volume mean diameter (D50, weight average) 4.8 μm, particles having a diameter of 20 μm or greater 0.1% (weight), particles having a diameter of 5 μm or less 65% (number)

Core D:

Polyester Resin (acid value 10, Mw/Mn=10, Mw=30000, Mn=3000) 92%/metal (including Fe in the main metal) complex based charge control agent (CCA) 1%/carbon black 4%/ester type wax with $T_m$=70±3° C. 3%/mean diameter (D50, weight average) 5.9 μm, particles having a diameter of 20 μm or greater 0.1% (weight), particles having a diameter of 5 μm or less 52% (number)

Figure 3:
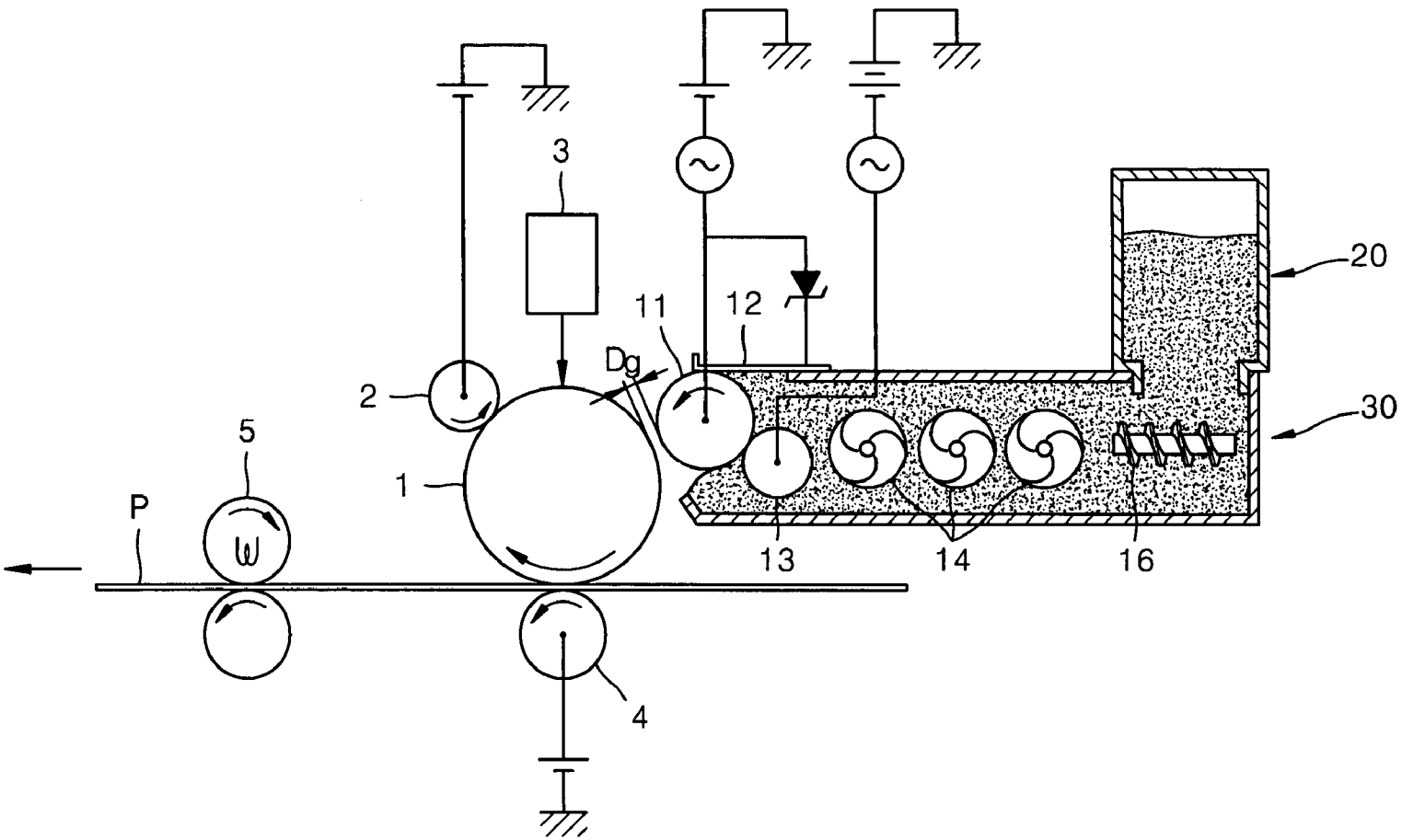
FIG. 3 is a schematic view of a developing apparatus according to another exemplary embodiment of the present invention.

As illustrated in FIG. 3, the developing unit 30 used three agitators 14. First, toner CA was added to the developing unit 30. A high quality image was printed.

When 20% of toner CA in the developing unit 30 was consumed, toner DA was added. A high quality image was maintained.

Toner CA was added to an empty developing unit 30 and when 90% of toner CA was consumed, toner DA was added. A high quality image was printed. When 90% of this toner, which was a mixture of Toner CA and Toner DA, was consumed, toner CA was added. A high quality image was printed.

Fourth Exemplary Embodiment

Two toners with the same cores and different external additives were used to check image quality. Toner ED was a mixture of core E and external additive D. Toner EE was a mixture of core E and external additive E. The mean diameter of toner ED and toner EE was in the range of 4 to 12 μm.

Core E:

Polyester Resin (acid value 10, Mw/Mn=30, Mw=90000, Mn=3000) 92%/boron complex based charge control agent (CCA) 1%/carbon black 4%/ester type wax with $T_m$=70±3° C. 1.5%/mean diameter (D50, weight average) 8.5 μm, particles having a diameter of 20 μm or greater 0.1% (weight), particles having a diameter of 5 μm or less 21% (number)

External Additive D:

Hydrophobic silica having a specific surface (according to the BET method) of 300 $m^2/g$ with the surface treated with silicon oil 1%/hydrophobic silica having a specific surface (according to the BET method) of 130 $m^2/g$ with the surface treated with HMDS 1%/$TiO_2$ 0.4%

External Additive E:

Hydrophobic silica having a specific surface (according to the BET method) of 200 $m^2/g$ with the surface treated with silicon oil 1%/hydrophobic silica having a specific surface (according to the BET method) of 120 $m^2/g$ with the surface treated with silicon oil 1%/$TiO_2$ 0.2%

As illustrated in FIG. 1, the developing unit 30 includes two agitators 14. The developing unit 30 was filled first with toner ED. A high quality image was printed.

When 20% of toner ED in the developing unit 30 was consumed, toner EE was added. A high quality image was printed.

Toner ED was added to an empty developing unit 30, and when 50% of toner ED was consumed, toner EE was added. A high quality image was printed.

Toner ED was added to an empty developing unit 30, and when 90% of toner ED was consumed, toner EE was added. A high quality image was printed.

When 90% of this toner, which was a mixture of Toner ED and Toner EE, was consumed, toner EE was added. A high quality image was printed.

Then, the moving speed of the toner transferred by the agitators 14 was measured. Here, toners of different colors were added to the developing unit 30 and the moving speed of these toners was measured. The moving speed of the toners was 12 mm/s and was lower than the developing process speed of 150 mm/s.

Fifth Exemplary Embodiment

The charge amounts of toners of two different compositions of exemplary embodiment 1, that is, toner AA and toner AB, were measured using a blow-off charge measurement apparatus. The toner charge amount was measured using the method established by the Japanese Image Society in December, 1998, as described in the Journal of The Imaging Society of Japan, vol. 37, p. 461, and a TB 203 type blow-off charge measurement apparatus manufactured by Toshiba Chemicals was used to perform the measurements. The charge amount Q1 of toner AA was −20.4 μC/g, the charge amount Q2 of toner AB was −21.3 μC/g, and the pollution level of the background on the image receptor 1 was 0.02. The background contamination level was measured using an optical density measuring apparatus; the greater the measured value, the higher the pollution level of the background due to toners. Then the charge amount was controlled by changing the kind and content of CCA of toner AB and the kind and added amount of external additives. The toner whose charge amount was controlled, is referred to as toner ab. Thus, the ratio Q1/Q2 of toner AA and toner ab was controlled in the range of 0.4 to 1.7. The charge amount can be reduced either by extremely increasing the additive amount of metal complex based CCA by more than 8% or by keeping the additive amount of CCA within 1 to 3% and using hydrophilic silica as an external additive. To increase the charge amount, silica which has a specific surface (according to the BET method) of 130 $m^2/g$ can be added by more than 1%, or fine particles such as acryl resin or melamin resin with a mean diameter of 0.05 to 0.5 μm can be added in the range of 0.1 to 1.0%.

Figure 4:
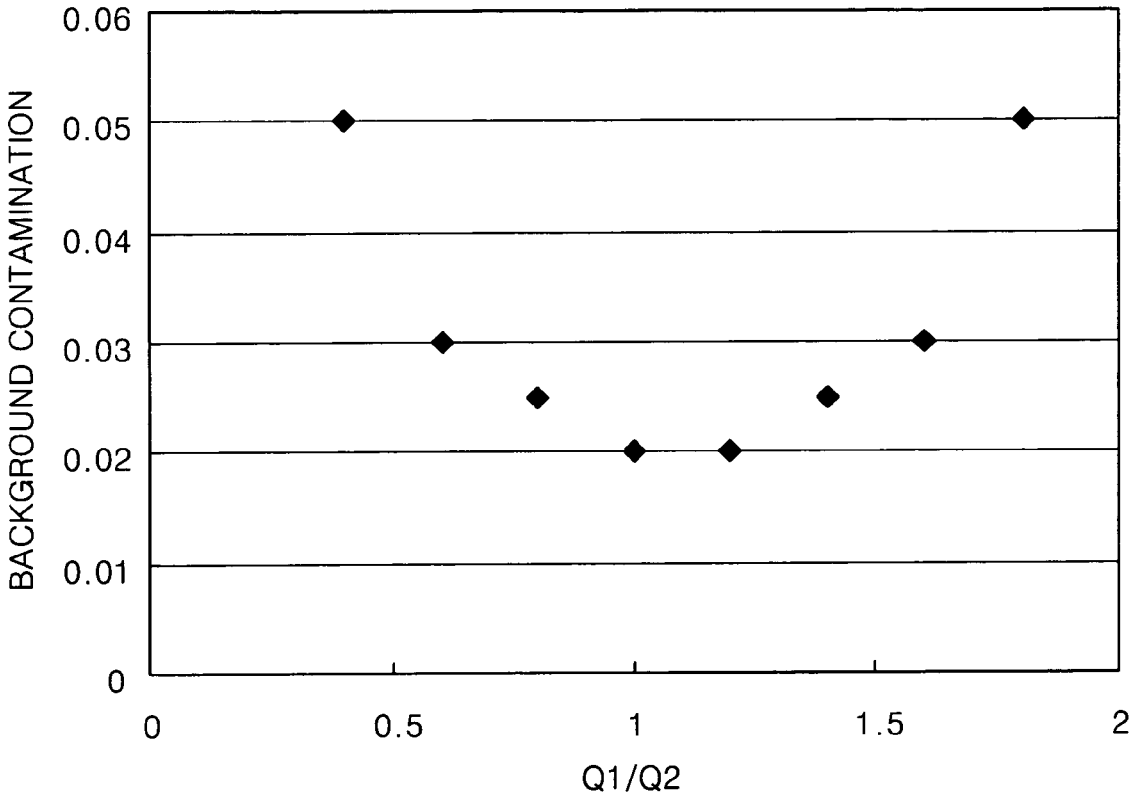
FIG. 4 is a graph illustrating the relation of the ratio of the charge amount of two kinds of toner of compositions and the background contamination of an image.

Toner ab which was manufactured in the above described manner and had several charge amounts was mixed with toner AA in the weight ratio of 1:1. The same image as in exemplary embodiment 1 was printed. As illustrated in FIG. 4, when the ratio Q1/Q2 was in the range of 0.6 to 1.7, a high quality image with background contamination level of 0.03 or less was obtained. However, when the ratio Q1/Q2 deviated from this range, the contamination level of the background rapidly increased.

First Comparative Example

Two toners with different cores and the same external additive were used to check image quality. Toner AA was a mixture of core A (the same as in exemplary embodiment 1) and external additive A (the same as in exemplary embodiment 1). Toner FA was a mixture of core F and external additive A (the same as in exemplary embodiment 1). The mean diameter of toner AA and toner FA was in the range of 4-12 μm. The difference of the mean diameter of toner AA and toner FA was 1.9 μm, which is greater than 1.5 μm. The difference in the percentages of the fine particles of 5 μm or less of toner AA and toner FA was 18%, which is greater than 15%.

Core F:

Polyester Resin (acid value 10, Mw/Mn=10, Mw=30000, Mn=3000) 92%/boron complex based charge control agent (CCA) 1%/carbon black 4%/ester type wax with $T_m$=70±3° C. 3%/mean diameter (D50, weight average) 6.6 μm, particles having a diameter of 20 μm or greater 0.1% (weight), particles having a diameter of 5 μm or less 35% (number)

As illustrated in FIG. 1, the developing unit 30 included two agitators 14. First, toner AA was added to the developing unit 30. A high quality image was printed without any issues.

When 20% of toner AA in the developing was consumed, toner FA was added, and an image was printed. Toner was attached to a non-image portion of the printed image, that is, the image had background contamination.

Toner AA was added to an empty developing unit, and when 50% of toner AA was consumed, toner FA was added and an image was printed. However, background contamination still appeared.

Toner AA was added to an empty developing unit 30, and when 90% of toner AA was consumed, toner FA was added and an image was printed. However, background contamination still appeared. When 90% of the toner, which was a mixture of toner AA and toner FA, was consumed, toner FA was added and an image was printed. However, background contamination still appeared.

Second Comparative Example

Two toners with different cores and the same external additive were used to check image quality. Toner AA was a mixture of core A (the same as in exemplary embodiment 1) and external additive A (the same as in exemplary embodiment 1). Toner GA was a mixture of core G and external additive A (the same as in exemplary embodiment 1). The mean diameter of toner AA and toner GA was in the range of 4 to 12 μm. The difference of the mean diameter of toner AA and toner GA was 0.4 μm, smaller than 1.5 μm. The difference in the percentages of the fine particles of 5 μm or less of toner AA and toner GA was 3%, that was, which was smaller than 15%. Also, core G used styrene-acrylate type resin. In addition, although not illustrated, a developing unit including one agitator 14 was used.

Core G:

Styrene-acrylate Resin (Mn=30000) 92%/boron complex based charge control agent (CCA) 1%/carbon black 4%/ester type wax with $T_m$=70±3° C. 3%/mean diameter (D50, weight average) 8.1 μm, particles having a diameter of 20 μm or greater 0.1% (weight), particles having a diameter of 5 μm or less 20% (number)

First, toner AA was added to the developing unit 30. A high quality image was printed without any issues.

When 20% of toner AA in the developing unit 30 was consumed, toner GA was added, and an image was printed. The printed image had background contamination.

Toner AA was added to an empty developing unit, and when 50% of toner AA was consumed, toner GA was added to and an image was printed. However, background contamination still appeared.

Toner AA was added to an empty developing unit 30, and when 90% of toner AA was consumed, toner GA was added and an image was printed. However, background contamination still appeared. When 90% of the toner in the developing unit, which was a mixture of toner AA and toner GA, was consumed, toner AA was added and then an image was printed. However, background contamination still appeared.

Third Comparative Example

Two toners with different cores and the same external additive were used to check image quality. Toner AA was a mixture of core A (the same as in exemplary embodiment 1) and external additive A (the same as in exemplary embodiment 1). Toner BA was a mixture of core B (the same as in exemplary embodiment 2) and external additive A (the same as in exemplary embodiment 1). The mean diameter of toner AA and toner BA was in the range of 4-12 μm. The difference of the mean diameters of toner AA and toner BA was 1.2 μm, which is smaller than 1.5 μm. The difference in the percentages of the fine particles of 5 μm or less of toner AA and toner BA was 11%, which is smaller than 15%. Although not shown, a developing unit including only one agitator was used.

First, toner AA was added to the developing unit 30. A high quality image was printed without any issues.

When 20% of toner AA in the developing unit 30 was consumed, toner BA was added, and an image was printed. The printed image had background contamination.

Toner AA was added to an empty developing unit, and when 50% of toner AA was consumed, toner BA was added and an image was printed. However, background contamination still appeared.

Toner AA was added to an empty developing unit 30, and when 90% of toner AA was consumed, toner BA was added to and an image was printed. However, the background contamination still appeared. When, 90% of the toner in the developing unit, which was the mixture of toner AA and toner BA, was consumed, toner BA was added, and then an image was printed. However, background contamination still appeared.

As described above, in the developing unit according to the exemplary embodiments of the present invention, a high quality image can be produced even when using a mixture of two or more toners that have different cores and/or external additives.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing apparatus comprising an image receptor and a developing unit with a developing roller facing the image receptor, and in which toner can be added to the developing unit when existing toner in the developing unit is consumed, wherein the existing and added toners comprise cores and external additives, and at least one of the cores or the external additives of the added toner is different than that of the existing toner, and where the charge amounts of the existing and added toners are Q1 and Q2, respectively, the ratio Q1/Q2 is in the range of 0.6 to 1.7, and the absolute values of Q1 and Q2 are 10 μC/g or greater, respectively.

2. The developing apparatus of claim 1, wherein the added and existing toners have polyester-type cores.

3. The developing apparatus of claim 2, wherein the developing unit comprises two or more agitators that agitate and transfer toner to the developing roller and the moving speed of toner being moved by the agitators is lower than a developing process speed.

4. The developing apparatus of claim 1, wherein, the charge amount of the mixture of added and existing toner is Q12, and the ratios Q1/Q12 and Q2/Q12 are in the range of 0.6 to 1.7.

5. The developing apparatus of claim 4, wherein the difference between the charge amounts per mass of the added and existing toners and the difference between the toner masses per area of the added and existing toners on the developing roller are respectively 40% or less.

6. The developing apparatus of claim 5, wherein the added and existing toners have polyester-type cores, the developing unit comprises two or more agitators that agitate and transfer toner to the developing roller, the moving speed of toner being moved by the agitators is lower than a developing process speed.

7. The developing apparatus of claim 1, wherein the developing unit comprises two or more agitators that agitate and transfer toner to the developing roller.

8. The developing apparatus of claim 7, wherein the developing unit comprises four or less agitators.

9. The developing apparatus of claim 7, wherein the volume mean diameters of the added and existing toners are in the range of 4 to 12 μm, and the difference in the percentages of the particles having a diameter of 5 μm or less is 15% or less numerically.

10. The developing apparatus of claim 9, wherein the added and existing toners have polyester-type cores, and the moving speed of toner being moved by the agitators is lower than a developing process speed.

11. The developing apparatus of claim 7, wherein the volume mean diameter of the added and existing toners is in a range of 4 to 12 μm, and the difference of the volume mean diameters of the added and existing toners is within 1.5 μm.

12. The developing apparatus of claim 11, wherein the difference in the percentages of the particles having a diameter of 5 μm or less is 15% or less numerically.

13. The developing apparatus of claim 12, wherein the added and existing toners have polyester-type cores, and the moving speed of toner being moved by the agitators is lower than a developing process speed.

14. A developing apparatus comprising:

an image receptor; and a developing unit having a developing roller facing the image receptor, and two or more agitators disposed in the developing unit to agitate and transfer toner inside of the developing unit to the developing roller, wherein toner can be added when existing toner in the developing unit is consumed; and wherein the existing and added toners comprise cores and external additives, and at least one of the cores or the external additives of the added toner is different than those of the existing toner, and the volume mean diameters of the existing and added toners are in the range of 4 to 12 μm; and charge amounts of the existing and added toners are Q1 and Q2, respectively, and the ratio Q1/Q2 is in the range of 0.6 to 1.7, and the absolute values of Q1 and Q2 are 10 μC/g or greater, respectively.

15. The developing apparatus of claim 14, wherein the added and existing toners have polyester-type cores, and the moving speed of toner being moved by the agitators is lower than a developing process speed.

16. The developing apparatus of claim 14, wherein the charge amount of the mixture of added and existing toner is Q12, and the ratios Q1/Q12 and Q2/Q12 are in the range of 0.6 to 1.7.

17. The developing apparatus of claim 14, wherein the difference between the charge amounts per mass of the added and existing toners and the difference between the toner masses per area of the added and existing toners on the developing roller are respectively 40% or less.

18. A developing apparatus comprising:

an image receptor; and a developing unit having a developing roller facing the image receptor, and two or more agitators disposed in the developing unit to agitate and transfer toner inside of the developing unit to the developing roller, wherein toner can be added when existing toner in the developing unit is consumed, the existing and added toners comprise cores and external additives, and the cores of the added toner are different from the cores of the existing toner, and the volume mean diameters of the existing and added toners are in the range of 4 to 12 μm, the difference in the volume mean diameters of the existing and added toners are within 1.5 μm, and the difference in the percentages of the particles having a diameter of 5 μm or less is 15 % or less numerically.

19. The developing apparatus of claim 18, wherein the added and existing toners have polyester-type cores, and the moving speed of toner being moved by the agitators is lower than a developing process speed.

20. The developing apparatus of claim 19, wherein the charge amounts of the existing and added toners are Q1 and Q2, respectively, the ratio Q1/Q2 is in the range of 0.6 to 1.7, and the absolute values of Q1 and Q2 are 10 μC/g or greater, respectively.

21. The developing apparatus of claim 20, wherein the charge amount of the mixture of added and existing toner is Q12, and the ratios Q1/Q12 and Q2/Q12 are in the range of 0.6 to 1.7.

22. The developing apparatus of claim 21, wherein the difference between the charge amounts per mass of the added and existing toners and the difference between the toner masses per area of the added and existing toners on the developing roller are respectively 40% or less.

* * * * *

UNITED STATES PATENT AND TRADEMARK OFFICE

CERTIFICATE OF CORRECTION

PATENT NO. : 7,610,001 B2
APPLICATION NO. : 11/493632
DATED : October 27, 2009
INVENTOR(S) : Tsunemi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 622 days.

Signed and Sealed this

Twelfth Day of October, 2010

David J. Kappos

David J. Kappos
*Director of the United States Patent and Trademark Office*